United States Patent [19]

Lehtinen

[11] Patent Number: 4,506,457

[45] Date of Patent: Mar. 26, 1985

[54] METHOD AND APPARATUS FOR DRYING A PAPER, OR SIMILAR, WEB

[75] Inventor: Jukka Lehtinen, Tampere, Finland

[73] Assignee: OY Tampella AB, Tampere, Finland

[21] Appl. No.: 475,839

[22] Filed: Mar. 16, 1983

[30] Foreign Application Priority Data

Apr. 6, 1982 [FI] Finland ..... 821208

[51] Int. Cl.[3] ..... F26B 3/18

[52] U.S. Cl. ..... 34/41; 34/66; 34/73; 34/162; 34/216

[58] Field of Search ..... 34/71, 95, 9, 155, 162, 34/216, 209, 73, 75, 41, 66

[56] References Cited

U.S. PATENT DOCUMENTS 4,112,586 9/1978 Lehtinen ..... 34/95

*Primary Examiner*—Larry I. Schwartz

*Attorney, Agent, or Firm*—Ladas & Parry

[57] ABSTRACT

A method and an apparatus for drying a paper, or similar, web so that a wet web and a drying felt or wire are subjected to an air removal treatment, the web and the felt or wire freed of air are passed between moving surface elements having good heat conducting properties, said elements enclosing the web and the felt or wire along the whole width, the surface element contacting the web is heated in order to evaporate water contained in the web, and the surface element contacting the felt or wire is cooled in order to condense vapor emanating from the web into the felt or wire, and the felt or wire are separated from the dried web. The drying is carried out in two successive stages, and the surface elements are grouped so that each surface of the web at least in one stage comes into contact with the heated smooth surface element and in at least one further stage into contact with the drying felt or wire in order to distribute equally the markings caused by the drying felt or wire on the two surfaces of the web.

9 Claims, 1 Drawing Figure

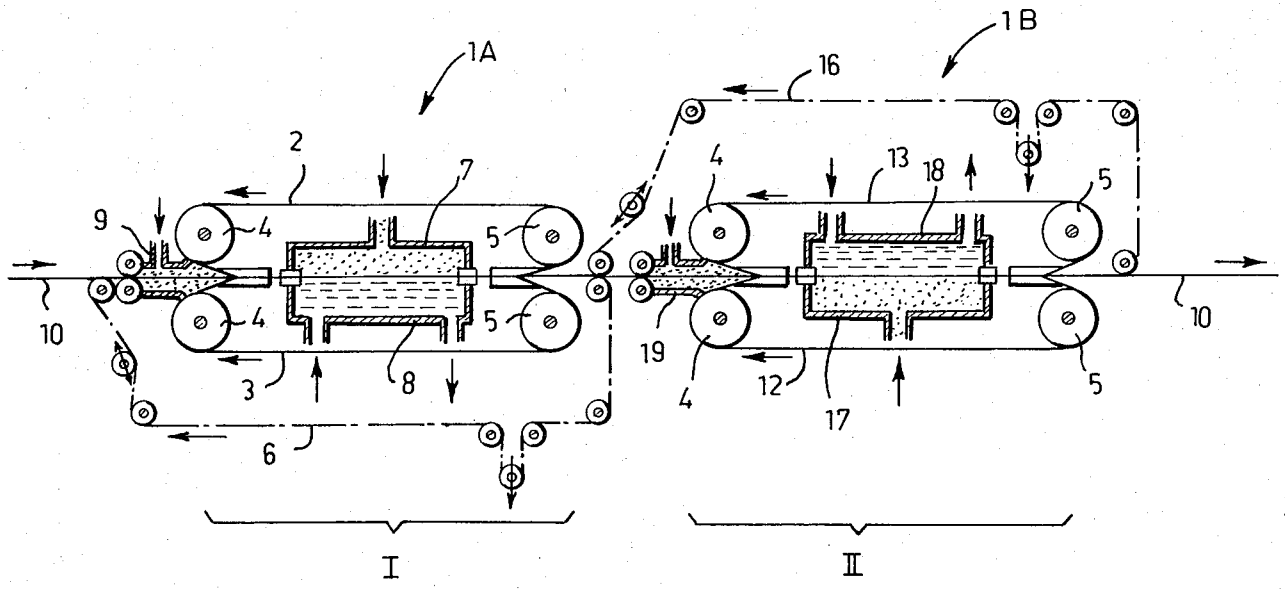
1A
1B
2
3
4
5
6
7
8
9
10
12
13
16
17
18
19
I
II

METHOD AND APPARATUS FOR DRYING A PAPER, OR SIMILAR, WEB

This invention relates to a method for drying a paper, cardboard, or other porous or fibrous web, according to which method a wet web and a drying felt or wire transporting means or are subjected to an air removal treatment, the web and transporting means or the drying felt or wire, freed of air, are passed between moving surface elements having good heat conducting properties, said elements enclosing the web along the whole width, the surface element contacting the web is heated in order to evaporate water contained in the web, and the surface element contacting transporting means or the drying felt or wire is cooled in order to condense vapour emanating from the web into the drying felt or wire, and transporting means or the drying felt or wire is separated from the dried web after the surface elements.

In drying carried out by means of a conventional drying cylinder, a similar roughness is produced on both surfaces of a paper or a cardboard web. However, the roughness is in general relatively high before calendering, the Bendtsen roughness (with the weight) of e.g., newsprint is typically in the range 900 to 1100 ml/min.

In the Finnish Patent Specifications Nos. 54514 and 55539 is described a suction drying method, in which a web is dried under a pressing effect of about 1 bar between a heated smooth surface element and transporting means or a drying felt or wire pressed against a cooled surface element. Before drying begins, almost all the air is removed from the pores of transporting means or the drying felt or wire, and the water evaporating from the web passes as vapour through transporting means or the drying felt or wire to condense subsequently on the cooled surface element. The surface elements are in general made of metal and move at the speed of the web. When using such a drying method, the resultant Bendtsen roughness (with the weight) of one of the web surfaces is typically 100 to 130 ml/min, but the roughness of the other web surface is very high because a depression pattern or marking caused by transporting means or the drying felt or wire is left in this surface. Though in some cases a high smoothness is desirable on one surface only, in most cases the same smoothness is desirable on both surfaces of the web.

So-called press drying of a paper or a cardboard web, during which drying the web is subjected both to a high temperature and a high pressure, has so far been carried out on a laboratory scale only. The Finnish Patent Application No. 810507 describes a method suitable for carrying out press drying on a large-scale production basis.

The object of this invention is to provide a method which eliminates the above-mentioned disadvantages and permits the application of both the suction drying method according to Patent Specifications Nos. 54514 and 55539, and the press drying method according to Patent Application No. 810507, in large-scale production in such a way that the relative roughness level of each surface of the web will be controllable and the average value of the roughnesses of the surfaces of the web can be held at a relatively low level. This object is achieved by means of the method according to the invention, which is characterized in that the drying is carried out at least in two successive stages, and in that each surface of the web, at least in one stage, is brought into contact with the hot smooth surface element and, at least in one further stage, into contact with transporting means or the drying felt or wire.

The invention is based on the idea of subjecting both surfaces of the web to be dried to a substantially similar overall treatment by exchanging the contact conditions between the surfaces during drying. For this reason, the drying is carried out at least in two stages, whereby one of the web surfaces in the first stage is passed into contact with the heated smooth surface element, and in the second stage into contact with transporting means or the drying felt or wire; and the opposite web surface is, in the first stage, passed into contact with transporting means or the drying felt or wire, and in the second stage with the heated smooth surface element. By proceeding in this manner, and by suitably selecting the length of each drying stage, the pressing effect applied to the web, and the weave types and finenesses of the felts or wires, it is possible to achieve the desired relative roughnesses on both surfaces of the web and, in addition, to obtain the desired low average value, within certain limits, for the surface roughnesses.

If the drying zones are oriented horizontally, it is preferable, according to the invention, to pass the web in the first drying stage into contact with a heated smooth surface element located above the web, and in a later stage into contact with a heated smooth surface element located below the web. This arrangement is preferable due to the fact that the water evaporating from the web during a drying stage collects as condensate on the surface of the cooled surface element facing the felt or wire. If a large quantity of condensate is collected and if said surface of the cooled surface element is located above the felt or wire, the condensate has a tendency to flow under the action of gravity through the felt or wire back into the web.

Because the drying rate of a wet web at the beginning of drying is higher than at the end, considerably more condensate is collected on the cooled surface element in the first drying stage than in the second drying stage, if the web traversing times are equally long in both stages. Upon suction drying newsprint between surface elements formed by bands, without using press drying conditions, it has been shown that, in order to obtain the same roughness on both surfaces of the web, the duration of the first drying stage must be only about 30% of the total drying time. When drying newsprint in this manner, without pressurized cooling water, and utilizing a commercially available metal wire which has the same width as the paper machine and a 3-shed weave with 32 yarns/cm, a Bendtsen roughness (with the weight) of about 280 to 370 ml/min has been obtained on each surface of the paper.

If the felts or wires are similar in each drying stage, an exactly similar final marking is not obtained on the two surfaces of the web although a Bendtsen roughness measurement, for example, would indicate the same roughness level on both surfaces. This is, a.o., due to the fact that one of the web surfaces first contacts the smooth surface element and thereafter the felt or wire, while the opposite web surface contacts the surface element and the felt or wire in the opposite order.

The marking type can be influenced during the different drying stages by the roughness or structure of the felts or wires used. It is also possible to affect the markings produced by using a pressing effect of a different magnitude in the various drying stages.

The invention also relates to an apparatus for applying the method described above, and the apparatus is characterized by the features according to claim 4.

The invention will be described in more detail in the following with reference to the accompanying drawing, which illustrates schematically the principle of the two-stage drying method according to the invention, and an apparatus for carrying out the method in side view.

The drying apparatus shown in the drawing comprises two drying sections 1A and 1B located in series. The first drying section 1A includes two endless, smooth-surfaced bands, 2 and 3, made of a liquid-impermeable material, such as metal, and passing around turning rolls 4, 5. The runs of said bands facing each other are guided so that the bands pass substantially horizontally, and parallelly to each other. Between the bands runs transporting means or an endless drying belt or wire 6, which makes its circuit on its own turning rolls, enclosing the lower band 3.

The drying section 1A further includes a heating chamber 7 which is mounted above the lower pass of the band 2, and into which a heating medium, such as steam, is introduced for heating the lower pass length of the band. Under the upper pass of the lower band 3 is mounted a cooling chamber 8 into which a cooling medium, such as water, is introduced for cooling the upper pass length of the band.

On the inlet side of the bands there is an air removal means 9, through which transporting means or the drying felt or wire 6 passes. The web to be dried is denoted by the reference numeral 10.

The drying section 1B includes the same parts as the drying section 1A, but the parts are arranged in mirror image with respect to the drying section 1A, i.e., transporting means or the drying felt or wire 16 passes around an upper band 13, and a heating chamber 17 is mounted for heating a lower band 12, and a cooling chamber 18 is arranged for cooling the upper band 13. On the inlet side of the bands 12, 13 is similarly mounted an air removal means 19, through which transporting means or the drying felt or wire 16 passes.

The drying sections 1A and 1B are located so that that the drying zone formed by the bands 2, 3 of the first drying section and the drying zone formed by the bands 12, 13 of the second drying section are coplanar. In this way the web 10, to be dried, makes a straight pass through the drying apparatus.

The web to be dried is passed on transporting the drying felt or wire 6 to the air removal means 9 of the first drying section 1A, where the web and the felt or wire are nearly completely deaerated. The web further passes on the felt or wire in between the bands 2, 3, whereby the upper surface of the web is contacted with the upper heated smooth band 2 and transporting means or the drying felt or wire 6 is contacted with the lower cooled band 3. As a result of this, the water contained in the wet web evaporates and passes through transporting means or the drying felt or wire into contact with the cooled band, on the surface of which the vapour condenses.

After passing through the first drying section the web is directly transferred to the second drying section 1B. The web, together with transporting means or the drying felt or wire 16, passes through the air removal means 19, and further in between the bands 12, 13. At this point the upper surface of the web, which in the first drying section contacted the heated smooth band, is in contact with transporting means or the drying felt or wire 16, while the lower surface of the web, which in the first drying section contacted transporting means or the drying felt or wire, now in turn is in contact with the heated smooth band 12. The cooled band 13 is pressed against transporting means or the drying felt or wire.

When the web has passed through the second drying section, transporting means or the drying felt or wire is separated from the dried web, and the web is passed onto finishing operations.

It will be noted that, by carrying out the entire drying process in two stages I and II, each surface of the web can be passed into contact with both the heated smooth band and transporting means or the drying felt or wire.

The drawing and the description relating thereto are only intended to illustrate the idea of the invention. In its details the method according to the invention and the apparatus for applying said method may vary considerably within the scope of the claims. Thus, it is possible to divide the web drying process into more than two successive stages, in which case each surface of the web is alternatingly contacted with the smooth band and transporting means or the drying felt or wire. Although the surface elements, between which the web to be dried and transporting means or the drying felt or wire are passed, are shown in the drawing as bands 2 and 3, and 12 and 13, respectively, it is possible to use as one surface element a press roll having a hard shell, and as the other surface element a band, or a press roll having a flexible shell, or a slide shoe; by means of which successive drying zones will be formed, in which the wet web can be subjected to heating and cooling actions similar to the ones described above. If the web is dried on drying cylinders, as described in Patent Application No. 810507, the web passes on the first cylinder with one surface against the heated smooth cylinder surface, and when passing the second cylinder the same surface of the web does not contact said second cylinder but is in contact with transporting means or the drying felt or wire. In this case, however, there is usually no need to worry about the flow of condensate from the cooled band back to the web because the centrifugal force retains the condensed water on the surface of the cooled band.

What I claim is:

1. A method for drying a paper, a cardboard and other porous, fibrous web having two opposite surfaces, said web having a direct contact with transporting means which comprises:

removing air from said wet web and said transporting means;

passing said web and said transporting means between moving surface elements having good heat conductive properties, said elements enclosing said web along a whole width thereof, said web and said transporting means having simultaneous contacts each with one of said moving surface elements;

heating of a smooth surface element contacting said web for evaporating a liquid contained in said web, and cooling a surface element contacting said transporting means for condensing vapors emanating from said web into said transporting means; and separating said web from said transporting means, whereby said drying method is carried out in at least two successive stages, each said surface of said web, during at least one said stage, being brought into a contact with a hot smooth surface element and at least in one further said stage into a contact with said transporting means.

2. A method according to claim 1, wherein said web in the first drying stage is brought into contact with a heated smooth surface element located above said web, and in a subsequent stage into contact with a heated smooth surface element located below said web.

3. A method according to claim 1, wherein the drying is carried out in two stages, and wherein the traversing time of said web through the first stage is about 30% of the total traversing time for both stages.

4. The method according to claim 1 wherein said transporting means is a felt.

5. The method according to claim 1 wherein said transporting means is a wire.

6. An apparatus for drying a paper, a cardboard and other porous, fibrous web comprising:

said web and transporting means for transporting of said web having a direct contact with each other;

air removing means for removing of air from said web and said transporting means;

a plurality of moving surface elements, comprising pairs of such surface elements, each pair running along of at least a portion of their path of movement in a direction substantially parallel to each other, said web and transporting means, said web and said transporting means being positioned between, and having simultaneous contact, each with one of said moving surface elements;

heating means for heating of a smooth surface element contacting said web; and cooling means for cooling a surface element contacting said transporting means along said parallel path portion of said surface elements, whereby said plurality of said surface elements form at least two successive pairs of surface elements, each said pair having a smooth heated surface element, a cooled surface element and separate transporting means, said transporting means contacting said cooled surface element, and whereby said smooth heated surface element of at least one of said successive pairs of surface elements is positioned on one side of said web and said smooth heated surface element of at least one of said successive pairs of surface elements is positioned on another side of said web.

7. An apparatus according to claim 6, wherein the cooled surface element of at least said first pair of surface elements is located below the path of movement of said web to be dried.

8. The apparatus according to claim 6 wherein said transporting means is a felt.

9. The apparatus according to claim 6 wherein said transporting means is a wire.

* * * * *